US008499386B2

(12) United States Patent
Roleder et al.

(10) Patent No.: US 8,499,386 B2
(45) Date of Patent: Aug. 6, 2013

(54) ADJUSTABLE COVER FOR A MASSAGE DEVICE

(75) Inventors: Jonathan W Roleder, San Diego, CA (US); James Chenevey, Encinitas, CA (US)

(73) Assignee: Earthlite Massage Tables, Inc., Vista, CA (US)

( * ) Notice: Subject to any disclaimer, the term of this patent is extended or adjusted under 35 U.S.C. 154(b) by 413 days.

(21) Appl. No.: 12/652,473

(22) Filed: Jan. 5, 2010

(65) Prior Publication Data

US 2010/0170040 A1 Jul. 8, 2010

Related U.S. Application Data

(60) Provisional application No. 61/142,568, filed on Jan. 5, 2009.

(51) Int. Cl.
*A47B 7/00* (2006.01)

(52) U.S. Cl.
USPC ..... 5/620; 5/697; 5/727

(58) Field of Classification Search
USPC ..... 5/499, 740, 738, 737, 722, 723, 727, 5/620, 655.9, 622, 623, 725, 735, 401, 402, 5/411; 190/2; 24/382, 383
See application file for complete search history.

(56) References Cited

U.S. PATENT DOCUMENTS 3,443,671 A * 5/1969 Dyke ..... 190/103
3,910,630 A * 10/1975 Runyon et al. ..... 297/63
4,773,515 A * 9/1988 Kotkins, Jr. ..... 190/103
5,065,485 A * 11/1991 Zocco ..... 29/91.1
6,618,880 B1 * 9/2003 Chase ..... 5/500
6,934,988 B1 * 8/2005 Wetzler et al. ..... 5/621
7,194,778 B2 * 3/2007 Riach ..... 5/735
7,340,788 B1 * 3/2008 Traub ..... 5/697
2004/0019972 A1 * 2/2004 Schecter et al. ..... 5/645

* cited by examiner

*Primary Examiner* — Michael Trettel
*Assistant Examiner* — Richard G Davis
(74) *Attorney, Agent, or Firm* — Roeder & Broder LLP

(57) ABSTRACT

A body support assembly (326A) for supporting the body of a user of a massage device (10) includes a frame (334), a pad assembly (336) and a cover assembly (338). The pad assembly (336) is supported by the frame (334). The cover assembly (338) secures the pad assembly (336) to the frame (334). The cover assembly (338) includes a top cover section (360), a bottom cover section (362), and a section connector (364). The section connector (364) selectively moves between an open configuration and a closed configuration. When the section connector (364) is in the open configuration, the top cover section (360) is not directly connected to the bottom cover section (362). When the section connector (364) is in the closed configuration, the top cover section (360) is directly connected to the bottom cover section (362). The cover assembly (338) can further include a middle cover section (366) that is connected to the top cover section (360) and the bottom cover section (362). The middle cover section (366) is visible when the section connector (364) is in the open configuration and the middle cover section (366) is not visible when the section connector (364) is in the closed configuration. The cover assembly (338) can be selectively adjustable to enable the pad assembly (336) to be selectively moved between an expanded configuration and a compressed configuration.

20 Claims, 4 Drawing Sheets

ADJUSTABLE COVER FOR A MASSAGE DEVICE

RELATED APPLICATION

This application claims priority on U.S. Provisional Application Ser. No. 61/142,568 filed on Jan. 5, 2009 and entitled "Adjustable Cover for A Massage Device". As far as is permitted, the contents of U.S. Provisional Application Ser. No. 61/142,568 are incorporated herein by reference.

BACKGROUND

As the benefits of therapeutic massage are becoming more widely appreciated, more and more people are participating in therapeutic massage. A typical massage table allows the patient to be resting while receiving a massage. A typical massage chair allows the patient to be sitting while receiving a massage. Important features for massage devices include ease of use, light weight, high strength and support, and adjustability and comfort for the person receiving the massage.

SUMMARY

The present invention is directed to a body support assembly for supporting the body of a user of a massage device. The body support assembly includes a frame, a pad assembly and a cover assembly. The pad assembly is supported by the frame. The cover assembly secures the pad assembly to the frame.

As an overview, in certain embodiments, the body support assembly provides improved comfort, adjustability, and support to the user of the massage device. In some embodiments, the cover assembly is adjustable so that the body support assembly is movable between a compressed configuration and an expanded configuration. With this design, the flexing characteristics of certain areas of the body support assembly can be selectively adjusted to suit the requirements of the person resting against the body support assembly.

In some embodiments, the cover assembly includes a top cover section, a bottom cover section, and a section connector. In such embodiments, the section connector selectively moves between an open configuration and a closed configuration. In certain embodiments, when the section connector is in the open configuration, the top cover section is not directly connected to the bottom cover section. Conversely, when the section connector is in the closed configuration, the top cover section is directly connected to the bottom cover section.

In certain embodiments, the cover assembly further includes a middle cover section that is connected to the top cover section and the bottom cover section. In one such embodiment, the middle cover section is visible when the section connector is in the open configuration and the middle cover section is not visible when the section connector is in the closed configuration.

In one embodiment, the top cover section and the bottom cover section are made from a first cover material and the middle cover section is made from a second cover material that is different than the first cover material.

In some embodiments, the cover assembly is selectively adjustable to enable the pad assembly to be selectively moved between an expanded configuration and a compressed configuration.

In certain embodiments, the pad assembly includes a main pad component having one or more pad apertures, and one or more pad inserts that are adapted to be positioned within the one or more pad apertures. In one such embodiment, the main pad component is made from a first pad material and the one or more pad inserts are made from a second pad material that is different than the first pad material.

Additionally, the present invention is also directed to a massage device for supporting the body of a user above a surface during a massage, and a method for supporting the body of a user of a massage device above a surface during a massage.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Figure 1:
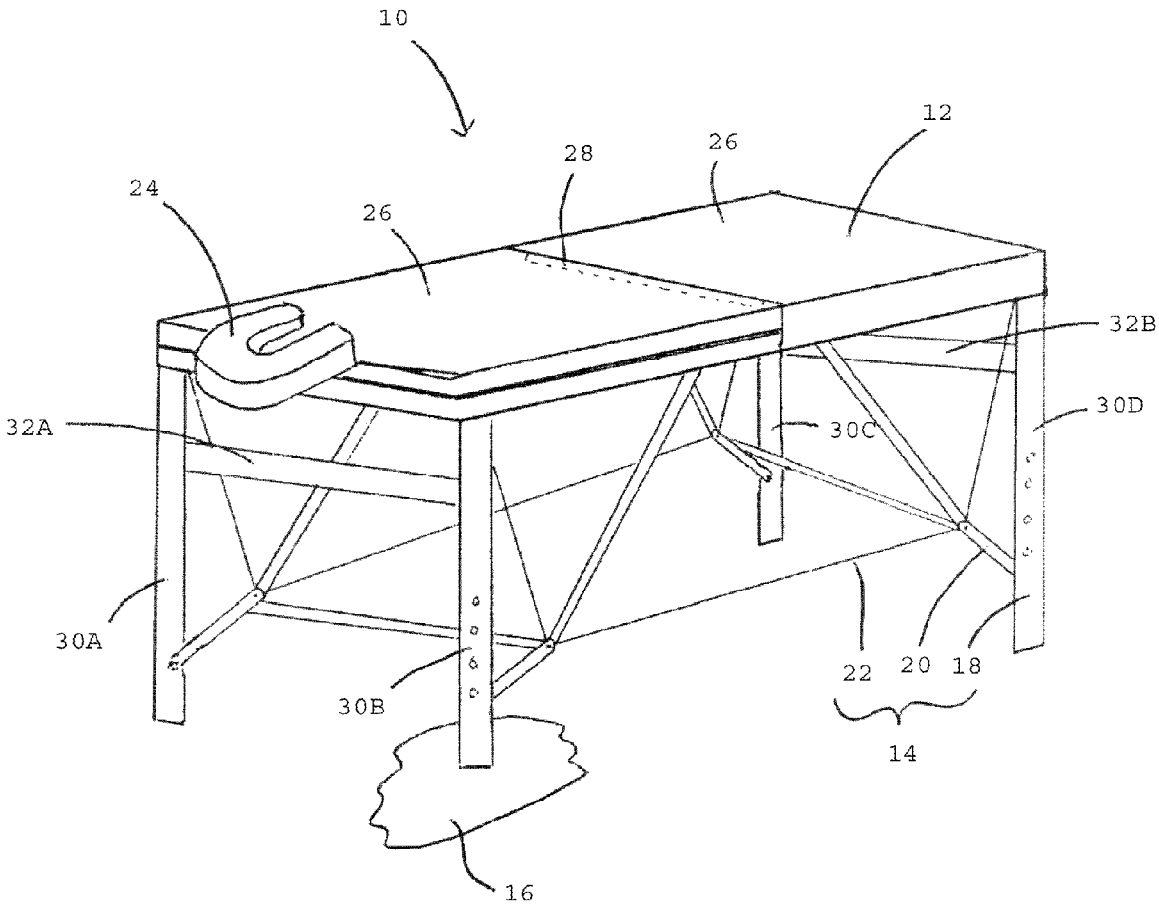
FIG. 1 is a perspective view of a massage device having features of the present invention.

FIG. 1 is a perspective view of a massage device 10 having features of the present invention. The design of the massage device 10 can be varied. In FIG. 1, the massage device 10 is a portable, folding massage table. One embodiment of a portable, folding massage table is disclosed U.S. Pat. No. 5,009,170, issued to Spehar, the contents of which are incorporated herein by reference. Alternatively, the massage device can be a salon type table somewhat similar to that disclosed and illustrated in U.S. Pat. No. 7,452,032, issued to Roleder et al., the contents of which are incorporated herein by reference. Still alternatively, for example, the massage device 10 can be another type of massage device, such as a massage chair. One embodiment of a massage chair is disclosed U.S. Pat. No. 6,729,690, issued to Roleder et al., the contents of which are incorporated herein by reference.

As an overview, in certain embodiments, the massage device 10 provides improved comfort and support to a person (also referred to as the "user") using the massage device 10. Further, the massage device 10 provides improved adjustability to suit the body, i.e. the body type and the body shape, of the user and the comfort needs of the user.

In the embodiment illustrated in FIG. 1, the massage device 10 is a portable massage table and includes (i) a table top assembly 12, (ii) a table support assembly 14 that supports the table top assembly 12 above a surface 16 (partly shown in FIG. 1) e.g., a floor, the table support assembly 14 having a leg assembly 18, a brace assembly 20 and a cable assembly 22; and (iii) a headrest assembly 24 that is selectively attached to the table top assembly 12 and that supports a face and/or a head of the user of the massage device 10. The design of the various components of the massage device 10 can be varied to achieve the desired shape, weight, and strength characteristics of the massage device 10. Alternatively, the massage device 10 can be designed with fewer or more components than that illustrated in FIG. 1. For example, the massage device 10 could be designed without the brace assembly 20 and/or the cable assembly 22 or with a different type of brace assembly 20 and/or cable assembly 22 than that illustrated in FIG. 1.

In certain embodiments, the massage device 10 is moveable between a working configuration (illustrated in FIG. 1) and a transport configuration (not shown). In the working configuration, the massage device 10 can be set up on the surface 16, and the massage device 10 is ready for supporting a person above the surface 16 for a massage. In the transport configuration, the massage device 10 can be moved relatively easily.

The table top assembly 12 provides a surface for a person to rest on during a massage. In the embodiment illustrated in FIG. 1, the table top assembly 12 is generally rectangular shaped. Alternatively, for example, the table top assembly 12 can be another shape, such as an oval shape, an oblong shape, or a rectangular shape with one or more rounded corners.

A typical table top assembly 12 includes one or more table top sections 26 for supporting a person during a massage. In the embodiment illustrated in FIG. 1, the table top assembly 12 includes two table top sections 26, and a hinge assembly 28 (illustrated in phantom) that connects the table top sections 26 together. As provided herein, the flexibility characteristics of one or more of the table top sections 26 can be selectively adjusted to enhance the comfort of the user and/or to suit the body characteristics of the user.

The hinge assembly 28 connects the table top sections 26 together and allows the table top sections 26 to pivot relative to each other between (i) the working configuration in which the table top sections 26 are substantially in the same plane, and (ii) the transport configuration in which the table top sections 26 are in substantially parallel planes with the table top sections 26 being side by side. In one embodiment, the hinge assembly 28 is a piano hinge that is attached to each of the table top sections 26. Alternatively, the hinge assembly 28 can have another design.

In one embodiment, a handle (not shown) may be attached to one or more of the table top sections 26 to facilitate carrying of the massage device 10 when the massage device 10 is in the transport configuration.

As noted above, in the embodiment illustrated in FIG. 1, the table support assembly 14 includes the leg assembly 18, the brace assembly 20, and the cable assembly 22. The leg assembly 18 extends between the table top assembly 12 and the surface 16 to maintain the table top assembly 12 positioned above and away from the surface 16 while the massage device 10 is in the working configuration. As illustrated in FIG. 1, the leg assembly 18 includes a first leg 30A, a second leg 30B, a third leg 30C, and a fourth leg 30D, wherein each leg 30A-30D is secured to and cantilevers downward from the table top assembly 12 near a corner of the table top assembly 12 so as to effectively support the table top assembly 12 above the surface 16 when the massage device 10 is in the working configuration.

It should be noted that the terms first, second, third and fourth are used for convenience only and that any of the legs 30A-30D can be designated as the first, second, third and fourth leg.

In certain embodiments, the legs 30A-30D can be pivotally secured to the table top assembly 12 to allow the legs 30A-30D to fold up underneath and inside the table top assembly 12 for easier and more compact portability and storage. Alternatively, the leg assembly 18 could be designed to have more than four or less than four legs 30A-30D and/or the legs 30A-30D can be secured to the table top assembly 12 in other locations than the corners of the table top assembly 12. Non-exclusive examples of suitable materials for the legs 30A-30D include wood, aluminum, steel, plastic or composite.

Additionally, in certain embodiments, one or more of the legs 30A-30D can be designed so that the length of the legs 30A-30D can be selectively adjusted to change the height of the table top assembly 12 relative to the surface 16 while the massage device 10 is in the working configuration.

The brace assembly 20 extends betweens the table top assembly 12 and the leg assembly 18 to provide additional support to the leg assembly 18 when the massage device 10 is in the working configuration. Further, the brace assembly 20 allows the legs 30A-30D to be easily moved between the transport configuration, and the working configuration illustrated in FIG. 1. In one embodiment, the massage device 10 further includes (i) a rigid first leg cross brace 32A that is attached to and extends between the first leg 30A and the second leg 30B, and (ii) a rigid second leg cross brace 32B that is attached to and extends between the third leg 30C and the fourth leg 30D. The leg cross braces 32A, 32B provide additional support to the legs 30A-30D and facilitate movement of the legs 30A-30D between the transport configuration and the working configuration. Non-exclusive examples of suitable materials for the leg cross braces 32A, 32B include wood, plastic, or aluminum. Alternatively, the massage device 10 can be designed without one or both leg cross braces 32A, 32B.

As shown in FIG. 1, the cable assembly 22 can include a plurality of cables that extend between the various elements of the massage device 10 to provide additional strength, stability and rigidity to the massage device 10 during operation and while in the working configuration. The cable assembly 22 also allows for easier fold-up and storage of the massage device 10. The features of suitable cable assemblies 22 are described in U.S. Pat. No. 4,833,998 issued to Everett et al. and U.S. Pat. No. 5,009,170 issued to Spehar, the contents of which are incorporated herein by reference.

The headrest assembly 24 provides a place to rest the head and/or face of the person receiving the massage. In some embodiments, the headrest assembly 24 is selectively attached to an end of the table top assembly 12. Alternatively, the headrest assembly 24 may be fixedly secured to an end of the table top assembly 12. Still alternatively, the headrest assembly 24 may include a face opening that is designed into the table top assembly 12 near an end of the table top assembly 12. In yet another alternative embodiment, the headrest assembly 24 can be positioned at another location. For example, for a massage chair, the headrest assembly 24 would extend generally upward at an angle.

Figure 2B:
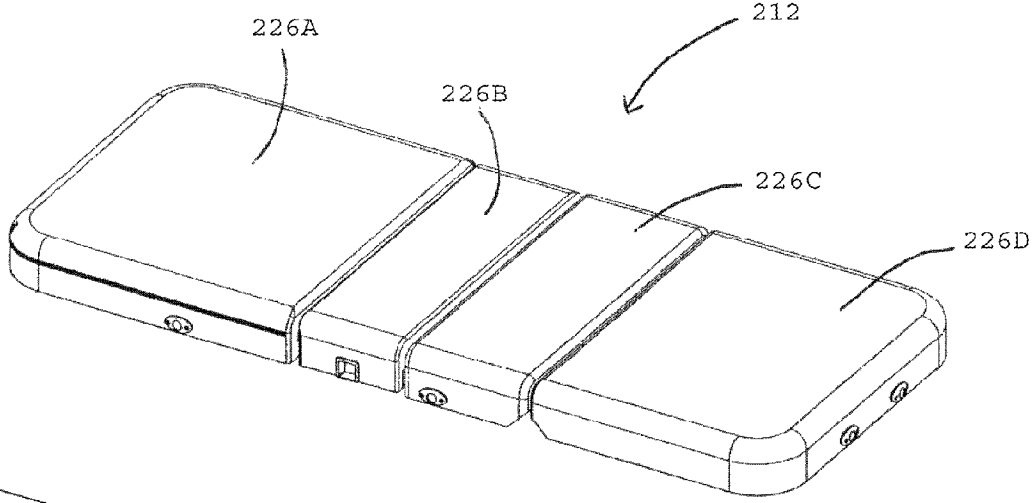
FIG. 2B is a top perspective view of the table top assembly of FIG. 2A, wherein the torso support assembly is in a compressed configuration.
Figure 2A:
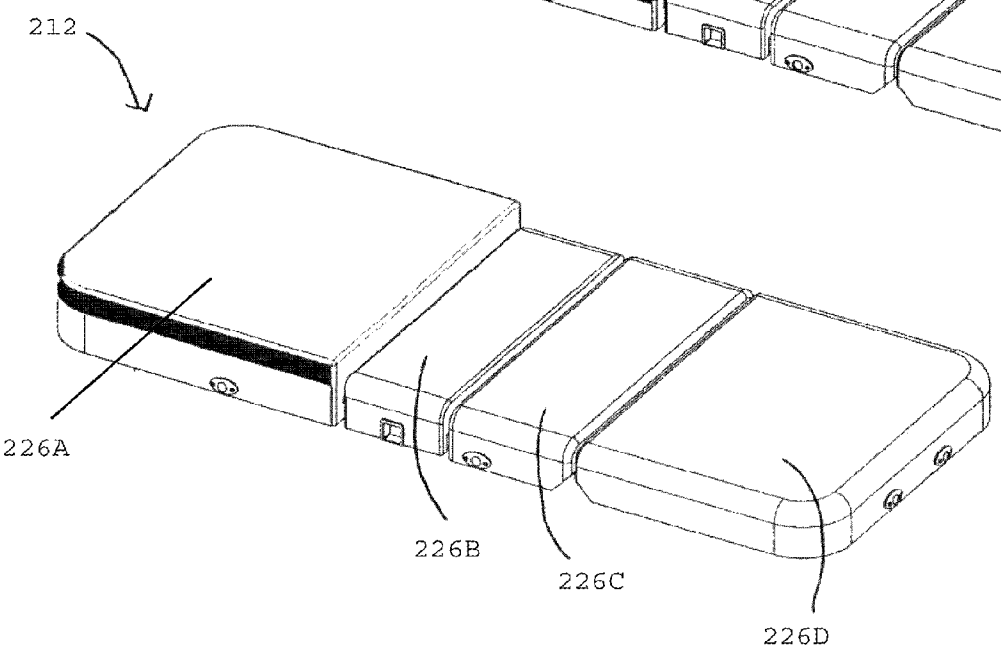
FIG. 2A is a top perspective view of a table top assembly having features of the present invention, including a torso support assembly in an expanded configuration.

FIG. 2A is a top perspective view of a table top assembly 212 for a salon type table having features of the present invention. The design of the table top assembly 212 can be varied to suit the specific design requirements of the massage device 10 (illustrated in FIG. 1). As illustrated in this embodiment, the table top assembly 212 includes a first table top section 226A (also referred to herein as a "torso support assembly"), a second table top section 226B, a third table top section 226C, and a fourth table top section 226D. The table top sections 226A-226D are also referred to sometimes herein as the "body support assemblies". Alternatively, the table top assembly 212 can be designed with more than four or less than four table top sections 226A-226D.

It should be noted that the use of the terms "first", "second", "third" and "fourth" with respect to the table top sections 226A-226D is utilized merely for convenience and ease in understanding the invention and are not intended to be limiting in any manner. In other words, any of the table top sections 226A-226D can be referred to as the "first table top section", the "second table top section", the "third table top section", and the "fourth table top section" without impacting the intended breadth and coverage of the present invention.

In certain embodiments, one or more of the table top sections 226A-226D, or body support assemblies, can be movable between an expanded configuration and a compressed configuration in accordance with the teaching of the present invention. With this design, the flexing characteristics of one or more of the table top sections 226A-226D can be selectively adjusted to suit the comfort requirements of the user. For example, FIG. 2A illustrates the first table top section 226A, or the torso support assembly, in an expanded configuration. Moreover, FIG. 2B is a top perspective view of the table top assembly 212 of FIG. 2A, wherein the torso support assembly 226A is in a compressed configuration. Alternatively, or additionally, one or more of the other table top sections 226B-226D can be designed to be adjustable between an expanded configuration and a compressed configuration.

Figure 3A:
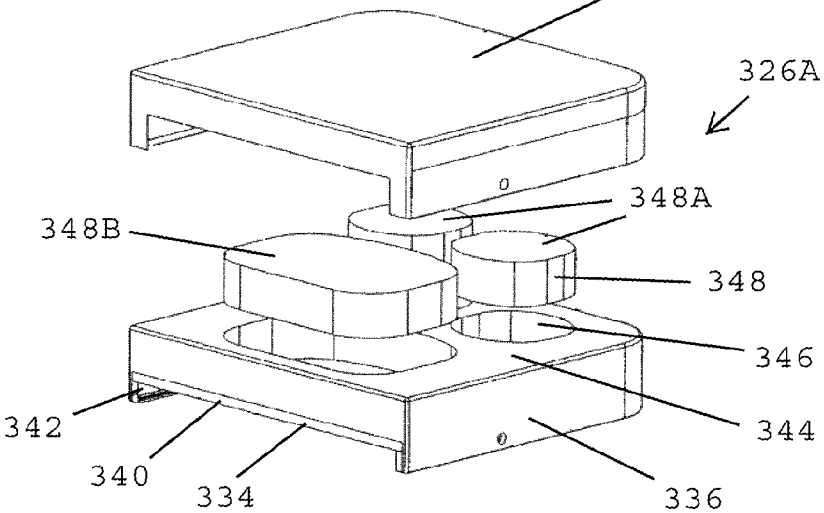
FIG. 3A is an exploded perspective view of an embodiment of a torso support assembly of a massage device having features of the present invention.

FIG. 3A is an exploded perspective view of an embodiment of one of the table top sections of a massage device 10 (illustrated in FIG. 1), e.g. a torso support assembly 326A having features of the present invention. The torso support assembly 326A supports the torso of the user of the massage device 10 during a massage. The design of the torso support assembly 326A can be varied depending on the requirements of the massage device 10. As illustrated in FIG. 3A, in one embodiment, the torso support assembly 326A includes a frame 334 that supports the torso of the user, a pad assembly 336, and a cover assembly 338.

Figure 3E:
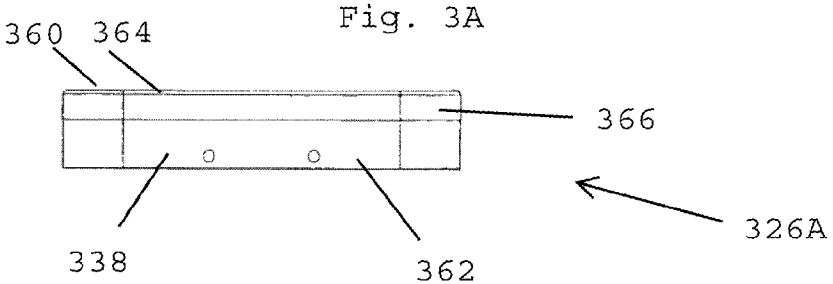
FIG. 3E is an end view of the torso support assembly of FIG. 3A in the expanded configuration
Figure 3B:
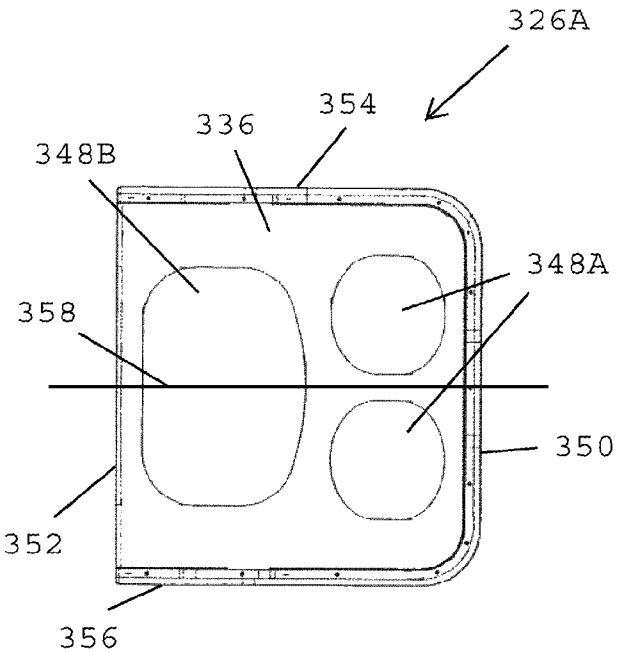
FIG. 3B is a bottom view of a portion of the torso support assembly of FIG. 3A.
Figure 3D:
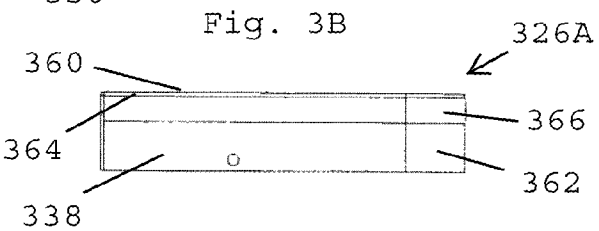
FIG. 3D is a side view of the torso support assembly of FIG. 3A in an expanded configuration.
Figure 3C:
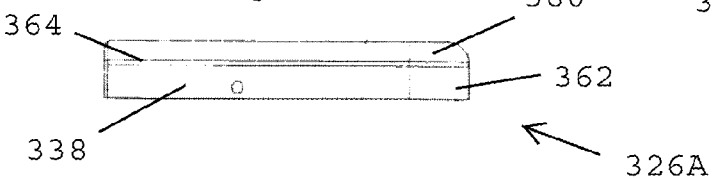
FIG. 3C is a side view of the torso support assembly of FIG. 3A in a compressed configuration.

As an overview, in certain embodiments, the table top assembly 212 (illustrated in FIG. 2A) provides improved comfort, adjustability and support for the user of the massage device 10 by enabling the torso support assembly 326A, or other body support assembly, to be selectively moved between an expanded configuration (illustrated in FIGS. 3D and 3E) and a compressed configuration (illustrated in FIG. 3C). Stated another way, in certain embodiments, the pad assembly 336 can be selectively moved between an expanded configuration and a compressed configuration, thereby enabling the torso support assembly 326A or other body support assembly to provide improved comfort, adjustability and support for the user of the massage device 10. In particular, when the torso support assembly 326A is in the expanded configuration, the cover assembly 338 is looser so as to allow the pad assembly 336 to expand, to be more flexible, and to more readily conform to the size and shape of the user of the massage device 10. Conversely, when the torso support assembly 326A is in the compressed configuration, the pad assembly 336 is more compressed and the pad assembly 336 is firmer. Thus, the cover assembly 338 can be used to selectively adjust the firmness of the pad assembly 336, and, in turn, selectively adjust the firmness of the torso support assembly 326A or other body support assembly.

In this embodiment, the frame 334 is generally rectangular shaped and includes a surface portion 340 and a perimeter portion 342. The surface portion 340 of the frame 334 is substantially planar and is positioned substantially parallel with the surface 16 (illustrated in FIG. 1) when the massage device 10 is in the working configuration. The surface portion 340 of the frame 334 supports the pad assembly 336. The perimeter portion 342 of the frame 334 cantilevers perpendicularly away from the surface portion 340 near the outer edge of the surface portion 340 so that the perimeter portion 342 extends toward the surface 16 when the massage device 10 is set up in the working configuration. In certain alternative embodiments, the frame 334 can have a different shape depending on the specific design requirements of the massage device 10. For example, in some embodiments, the frame 334 can be generally oval shaped, oblong shaped, circle shaped or some other shape.

The frame 334 is generally rigid and can be made of a rigid material such as wood, aluminum, plastic or other suitable materials.

The pad assembly 336 is positioned on the frame 334 and provides a cushion for the comfort of the person resting on the massage device 10. As illustrated in FIG. 3A, in certain embodiments, the pad assembly 336 includes a main pad component 344 having one or more pad apertures 346, and one or more pad inserts 348 that are adapted to be positioned within the one or more pad apertures 346. As illustrated in this embodiment, the main pad component 344 of the pad assembly 336 includes three pad apertures 346, and the pad assembly 336 includes three pad inserts 348. In alternative embodiments, the pad assembly 336 can be designed so that the main pad component 344 has more than three or less than three pad apertures 346, and so that the pad assembly 336 has more than three or less than three pad inserts 348. For example, in certain embodiments, the pad assembly 336 includes no pad apertures 346 and no pad inserts 348.

The size and shape of the pad apertures 346 and the pad inserts 348 can be varied depending on the requirements of the massage device 10. In the embodiment illustrated in FIG. 3A, the main pad component 344 of the pad assembly 336 includes two pad apertures 346 that are substantially circular shaped and one pad aperture 346 that is substantially oval shaped. Correspondingly, the pad assembly 336 includes two first pad inserts 348A that are substantially circular shaped and one second pad insert 348B that is substantially oval shaped. The first pad inserts 348A are designed to be positioned within the circular shaped pad apertures 346 so as to provide more comfortable support for the breasts of the user of the massage device 10. Additionally, the second pad insert 348B is designed to be positioned within the oval shaped pad aperture 346 so as to provide more comfortable support for the stomach of the user of the massage device 10.

It should be noted that the terms "first" and "second" with regard to the pad inserts 348A, 348B are used for convenience only and that either the substantially circular shaped pad inserts or the substantially oval shaped insert can be designated as the first pad insert(s) or second pad insert(s) without impacting the intended breadth and coverage of the present invention.

Non-exclusive examples of suitable materials for the main pad component 344 and the pad inserts 348A, 348B of the pad assembly 336 include foam, memory foam, fleece pads, etc. In one embodiment, the main pad component 344 is made from a standard foam material, whereas the pad inserts 348A, 348B are made from memory foam. For example, in alternative, non-exclusive embodiments, the main pad component 344 is approximately twenty, thirty, forty, fifty, sixty, or seventy percent stiffer than the pad inserts 348A, 348B. With this design, the pad inserts 348A, 348B are substantially softer and more flexible than the main pad component 344. Alternatively, the main pad component 344 and the pad inserts 348A, 348B can be made from the same material. Still alternatively, the first pad inserts 348A can be made from a different material than the second pad insert 348B.

The use of different foam materials for the main pad component 344 and the pad inserts 348A, 348B enables the torso support assembly 326A to provide additional and more flexible and comfortable support in areas that are more likely to require additional support, depending on the specific size and shape of the user of the massage device 10. For example, the first pad inserts 348A can provide more flexibility in the breast areas (e.g. for women with larger breasts) and the second pad insert 348B can provide more flexibility in the stomach area (e.g. for pregnant women) to provide improved comfort for a user of the massage device 10.

Yet alternatively, the main pad component 344 and/or the pad inserts 348 of the pad assembly 336 can include one or more fluid filled packages (e.g. gel packages or liquid filled packages).

Figure 4A:
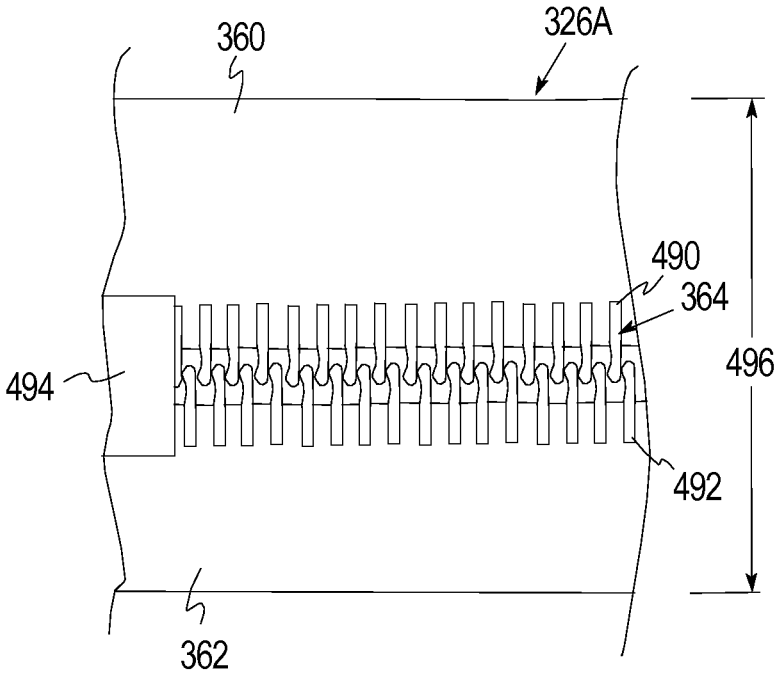
FIG. 4A is a simplified side view of a portion of the torso support assembly in the compressed configuration.

As provided herein, the pad assembly 336, e.g., of the torso support assembly 326A, is selectively moved between an expanded configuration (illustrated in FIG. 4B) and a compressed configuration (illustrated in FIG. 4A). In alternative non-exclusive embodiments, when the pad assembly 336 is in the expanded configuration, it has a height H that is at least approximately ten, fifteen, twenty, twenty-five, thirty, thirty-five, forty, forty-five, or fifty percent greater than the pad assembly 336 in the compressed configuration. Stated in another fashion, in alternative non-exclusive embodiments, when the pad assembly 336 is in the expanded configuration, it is expanded at least approximately 1, 1.5, 2, 2.5, 3, 3.5, 4, 5 inches from when the pad assembly 336 in the compressed configuration.

The cover assembly 338 substantially surrounds the pad assembly 336 and secures the pad assembly 336 to the frame 334. Moreover, the cover assembly 338 provides a protective covering for the pad assembly 336.

FIG. 3B is a bottom view of a portion of the torso support assembly 326A of FIG. 3A. In particular, FIG. 3B illustrates the torso support assembly 326A without the frame 334 so that the features and positioning of the pad assembly 336, e.g., the pad inserts 348A, 348B, is more clearly visible.

As shown in FIG. 3B, the torso support assembly 326A includes a first end 350, a second end 352, a first side 354, a second side 356, and a support axis 358. In this embodiment, the two first pad inserts 348A are spaced apart and symmetrically positioned on either side of the support axis 358 near the first end 350 of the torso support assembly 326A. In one embodiment, the first pad inserts 348A can extend approximately nine inches in the lateral direction between the first side 354 and the second side 356 and approximately 8.75 inches in the transverse direction between the first end 350 and the second end 352. Further, the first pad inserts 348A can be spaced apart approximately two inches. Alternatively, the first pad inserts 348A can be positioned differently within the pad assembly 336 and/or the first pad inserts 348A can have dimensions greater than or less than those described above.

It should be noted that the terms "first" and "second" with regard to the ends and the sides of the pad assembly are used for convenience only and that either end can be designated as the first end or the second end, and that either side can be designated as the first side and the second side without impacting the intended breadth and coverage of the present invention.

Further, in this embodiment, the second pad insert 348B is positioned symmetrically about the support axis 358 near the second end 352 of the torso support assembly 326A. In one embodiment, the second pad insert 348B can extend approximately 18 inches in the lateral direction between the first side 354 and the second side 356 and approximately 12.375 inches in the transverse direction between the first end 350 and the second end 352. Alternatively, the second pad insert 348B can be positioned differently within the pad assembly 336 and/or the second pad insert 348B can have dimensions greater than or less than those described above.

FIG. 3C is a side view of the torso support assembly 326A of FIG. 3A, with the torso support assembly 326A is in the compressed configuration. In particular, FIG. 3C illustrates certain features of the cover assembly 338.

The design of the cover assembly 338 can be varied depending on the specific requirements of the massage device 10. In certain embodiments, the cover assembly 338 is designed to be selectively adjustable so as to provide improved comfort, adjustability and support for the user of the massage device 10 by enabling the torso support assembly 326A, or body support assembly, to be moved between the expanded configuration and the compressed configuration. Stated another way, in certain embodiments, the cover assembly 338 is selectively adjustable to enable the pad assembly 336 to be selectively moved between the expanded configuration and the compressed configuration.

As shown in the embodiment illustrated in FIG. 3C, the cover assembly 338 can include a top cover section 360 that covers the top of the pad assembly 336 (illustrated in FIG. 3A), a bottom cover section 362 that is attached to the frame 334, and a section connector 364 (sometimes referred to as a "flexibility adjuster"). The top cover section 360 and the bottom cover section 362 are typically made of the same or similar materials. Non-exclusive examples of suitable materials for the top cover section 360 and the bottom cover section 362 include leather, vinyl, plastic, and cloth.

The section connector 364 is designed to selectively move between a closed configuration, illustrated in FIG. 3C, and an open configuration, illustrated in FIGS. 3D and 3E. Thus, the section connector 364 can be used to adjust the side profile of the torso support assembly 326A and the compression level of the main pad component 344 (illustrated in FIG. 3A) and the pad inserts 348 (illustrated in FIG. 3A). When the section connector 364 is in the closed configuration, as shown in FIG. 3C, the top cover section 360 is essentially connected directly to the bottom cover section 362, and the torso support assembly 326A is in the compressed configuration.

In one non-exclusive embodiment, the section connector 364 can be a zipper that extends around three sides of the torso support assembly 326A and that is selectively moved between the closed configuration and the open configuration. In this embodiment, when the zipper is closed, the top cover section 360 is pulled to the bottom cover section 362 to compress the pad assembly 336. Alternatively, when the zipper is opened, the top cover 360 is allowed to move away from the bottom cover section 362 so that the compression level of the pad assembly 336 is relaxed.

Alternatively, the section connector 364 can have a different design. For example, in some embodiments, the section connector 364 can include a plurality of snaps that are positioned around three sides of the torso support assembly 326A. In this embodiment, for example, when the snaps are snapped, the top cover section 360 is pulled to the bottom cover section 362 to compress the pad assembly 336. Alternatively, when the snaps are unsnapped, the top cover 360 is allowed to move away from the bottom cover section 362 so that the compression level of the pad assembly 336 is relaxed.

FIG. 3D is a side view of the torso support assembly of FIG. 3A, wherein the torso support assembly 326A is in the expanded configuration. In particular, FIG. 3D illustrates certain additional features of the cover assembly 338.

As illustrated in FIG. 3D, in addition to the top cover section 360, the bottom cover section 362 and the section connector 364, the cover assembly 338 further includes a middle cover section 366 that is positioned substantially between and is connected to the top cover section 360 and the bottom cover section 362. As shown in FIG. 3D, the middle cover section 366 is visible when the section connector 364 is in the open configuration and the torso support assembly 326A and the pad assembly 336 (illustrated in FIG. 3A) are in the expanded configuration. Conversely, in the embodiment illustrated in FIG. 3C, the middle cover section 366 is substantially not visible when the section connector 364 is in the closed configuration and the torso support assembly 326A and the pad assembly are in the compressed configuration.

Again referring to FIG. 3D, in certain embodiments, the middle cover section 366 is made from a different material than is used for the top cover section 360 and the bottom cover section 362. For example, the middle cover section 366 can be made of a flexible or expandable material such as elastic, nylon and/or mesh. Alternatively, the middle cover section 366 may be made from a different material such as leather, vinyl, plastic, and cloth.

When the section connector 364 is in the open configuration, as shown in FIG. 3D, the top cover section 360 is connected to the bottom cover section 362 through the middle cover section 366, which, as noted above, is positioned substantially between and is connected to the top cover section 360 and the bottom cover section 362. Stated another way, when the section connector 364 is in the open configuration, the top cover section 360 is not directly connected to the bottom cover section 362.

With this design, when the section connector 364 is moved to the open configuration, e.g., when the zipper is unzipped, this allows the middle cover section 366 to expand and the tightness of the cover assembly 338 to loosen. Alternatively, in one embodiment, when the zipper is unzipped the section connector 364 is moved to the closed configuration, and this pulls the top cover section 360 and the bottom cover section 362 together, essentially concealing the middle cover section 366, and tightens the cover assembly 338.

During use, when the torso support assembly 326A is in the expanded configuration, the cover assembly 338 (especially the top cover section 360) is looser so as to allow the pad assembly 336 to expand, to be more flexible, and to more readily conform to the size and shape of the user of the massage device 10 (illustrated in FIG. 1). Stated another way, by utilizing the torso support assembly 326A in the expanded configuration, any potential trampoline effect of the top cover section 360 that may be present due to a tighter cover assembly 338 is reduced. As a result thereof, the pad inserts 348 and the main pad component 344 are in an expanded configuration, more relaxed, less firm and better able to conform to the shape of the user. Alternatively, when the torso support assembly 326A is in the compressed configuration, as shown in FIG. 3C, the pad assembly 336 is more compressed and the pad assembly 336 is firmer. Thus, the section connector 364 can be used to selectively adjust the firmness of the pad assembly 336, and, in turn, selectively adjust the firmness of the torso support assembly 326A or other body support assembly.

FIG. 3E is an end view of the torso support assembly 326A of FIG. 3A in the expanded configuration. In particular, FIG. 3E again shows the top cover section 360, the bottom cover section 362, the section connector 364, and the middle cover section 366 of the cover assembly 338. In FIG. 3E, the section connector 364 is again in the open configuration, and thus the torso support assembly 326A is in the expanded configuration. Accordingly, the pad assembly 336 is again allowed to expand, to be more flexible, and to more readily conform to the size and shape of the user of the massage device 10 (illustrated in FIG. 1).

Figure 4B:
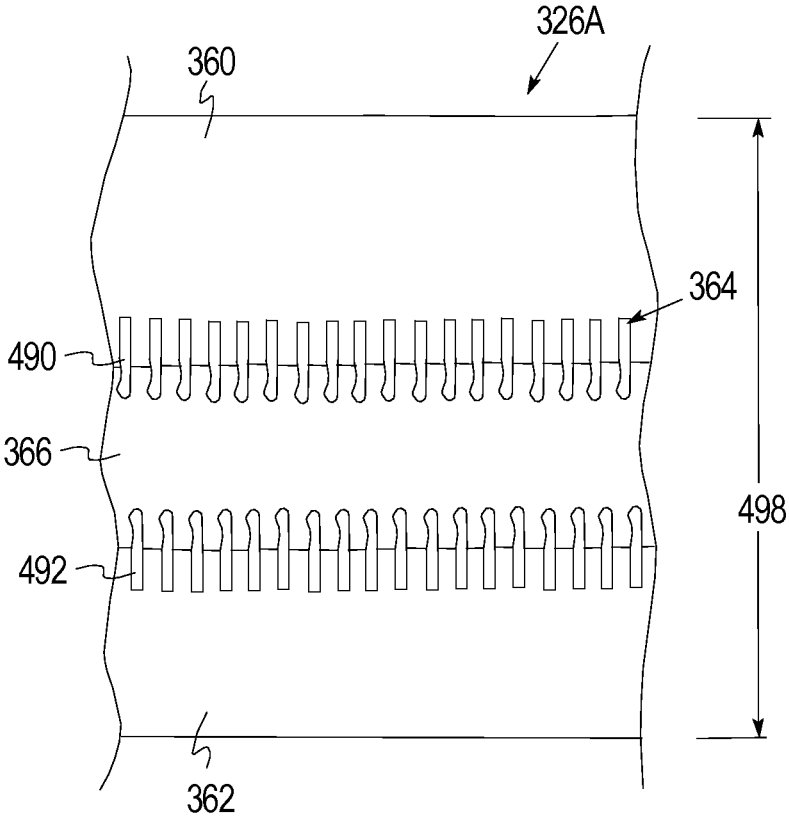
FIG. 4B is a simplified side view of a portion of the torso support assembly in the expanded configuration.

FIG. 4A is a side view of a portion of the torso support assembly 326A in the compressed configuration, and FIG. 4B is a side view of a portion of the torso support assembly 326A in the expanded configuration. These Figures also illustrate the operation of the section connector 364 in more detail. More specifically, these Figures illustrate that the section connector 364 can be a zipper that includes a first row of teeth 490 that is attached to the top cover section 360, a second row of teeth 492 that is attached to the bottom cover section 362, and a slider 494 (only partly illustrated in FIG. 4A). With this design, the slider 494 can be selectively moved in one direction to move the rows of teeth 490, 492 so that they mesh together, or selectively moved in the opposite direction to separate the rows of teeth 490, 492.

Referring to FIG. 4A, when the rows of teeth 490, 492 are meshed together, (i) the top cover section 360 is pulled to the bottom cover section 362, (ii) the pad components (not shown in FIG. 4A) of the torso support assembly 326B are compressed, and (iii) an overall height 496 of the torso support assembly 326B is relatively small. Referring to FIG. 4B, in contrast, when the rows of teeth 490, 492 are separated, the pad components of the torso support assembly 326B are allowed to expand. This causes (i) the first row of teeth 490 to be moved upward and away from the second row of teeth 492, (ii) the top cover section 360 to move away from the bottom cover section 362, (iii) the tension of the top cover section 360 to be reduced, (iv) the middle cover section 366 to be exposed, and (v) an overall height 498 of the torso support assembly 326B to be relatively large.

While a number of exemplary aspects and embodiments of a massage device 10 have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. A body support assembly for supporting the body of a user of a massage device, the body support assembly comprising:

a rigid frame;

a pad assembly that is supported by the frame; and a cover assembly that secures the pad assembly to the frame, the cover assembly including a top cover section, a bottom cover section that is secured to the frame, and a section connector that selectively moves between an open configuration wherein the top cover section is positioned away from the bottom cover section so that the pad assembly is in an expanded configuration, and a closed configuration wherein the top cover section is positioned near the bottom cover section so that the pad assembly is in a compressed configuration, and wherein the pad assembly in the expanded configuration has a height that is at least ten percent greater than a height of the pad assembly in the compressed configuration.

2. The body support assembly of claim 1 wherein the cover assembly further includes a middle cover section that is connected to the top cover section and the bottom cover section.

3. The body support assembly of claim 2 wherein the middle cover section is visible when the section connector is in the open configuration and the middle cover section is not visible when the section connector is in the closed configuration.

4. The body support assembly of claim 2 wherein the top cover section and the bottom cover section are made from a first cover material and the middle cover section is made from a second cover material that is different than the first cover material.

5. The body support assembly of claim 1 wherein the pad assembly includes a main pad component having one or more pad apertures, and one or more pad inserts that are adapted to be positioned within the one or more pad apertures.

6. The body support assembly of claim 5 wherein the main pad component is made from a first pad material and the one or more pad inserts are made from a second pad material that is different than the first pad material.

7. A massage device for supporting the body of a user above a surface during a massage, the massage device comprising the body support assembly of claim 1 and a device support assembly that supports the body support assembly above the surface.

8. A body support assembly of a massage device, the body support assembly supporting at least a portion of the body of a user of the massage device during a massage, the body support assembly comprising:

a rigid frame;

a pad assembly that is supported by the frame; and a cover assembly that secures the pad assembly to the frame, the cover assembly being selectively adjustable to enable the pad assembly to be selectively moved between an expanded configuration and a compressed configuration, the cover assembly including a bottom cover section that is secured to the frame.

9. The body support assembly of claim 8 wherein the pad assembly includes a main pad component having one or more pad apertures, and one or more pad inserts that are adapted to be positioned within the one or more pad apertures.

10. The body support assembly of claim 9 wherein the main pad component is made from a first pad material and the one or more pad inserts are made from a second pad material that is different than the first pad material.

11. The body support assembly of claim 8 wherein the cover assembly further includes a top cover section, a middle cover section that is connected to the top cover section and the bottom cover section, and a section connector that selectively moves between an open configuration wherein the top cover section is not directly connected to the bottom cover section and a closed configuration wherein the top cover section is directly connected to the bottom cover section.

12. The body support assembly of claim 11 wherein the middle cover section is visible when the section connector is in the open configuration and the middle cover section is not visible when the section connector is in the closed configuration.

13. The body support assembly of claim 11 wherein the top cover section and the bottom cover section are made from a first cover material and the middle cover section is made from a second cover material that is different than the first cover material.

14. A massage device for supporting the body of a user above a surface during a massage, the massage device comprising the body support assembly of claim 8 and a device support assembly that supports the body support assembly above the surface.

15. A body support assembly for supporting the body of a user of a massage device, the body support assembly comprising:

a frame;

a pad assembly that is supported by the frame; and a cover assembly that secures the pad assembly to the frame, the cover assembly including a top cover section, a bottom cover section, a middle cover section that is connected to the top cover section and the bottom cover section, and a section connector that selectively moves between an open configuration wherein the top cover section is positioned away from the bottom cover section so that the pad assembly can expand, and a closed configuration wherein the top cover section is positioned near the bottom cover section so that the pad assembly is compressed, and wherein the middle cover section is visible when the section connector is in the open configuration and the middle cover section is not visible when the section connector is in the closed configuration.

16. A body support assembly for supporting the body of a user of a massage device, the body support assembly comprising:

a frame;

a pad assembly that is supported by the frame; and a cover assembly that secures the pad assembly to the frame, the cover assembly including a top cover section, a bottom cover section, a middle cover section that is connected to the top cover section and the bottom cover section, and a section connector that selectively moves between an open configuration wherein the top cover section is positioned away from the bottom cover section so that the pad assembly can expand, and a closed configuration wherein the top cover section is positioned near the bottom cover section so that the pad assembly is compressed, and wherein the top cover section and the bottom cover section are made from a first cover material and the middle cover section is made from a second cover material that is different than the first cover material.

17. The body support assembly of claim 16 wherein the pad assembly includes a main pad component having one or more pad apertures, and one or more pad inserts that are adapted to be positioned within the one or more pad apertures.

18. The body support assembly of claim 17 wherein the main pad component is made from a first pad material and the one or more pad inserts are made from a second pad material that is different than the first pad material.

19. The body support assembly of claim 15 wherein the pad assembly includes a main pad component having one or more pad apertures, and one or more pad inserts that are adapted to be positioned within the one or more pad apertures.

20. The body support assembly of claim 19 wherein the main pad component is made from a first pad material and the one or more pad inserts are made from a second pad material that is different than the first pad material.

* * * * *